US010004302B1

(12) United States Patent
Egger

(10) Patent No.: US 10,004,302 B1
(45) Date of Patent: Jun. 26, 2018

(54) MODULAR MILITARY RIBBON HOLDER ASSEMBLY

(71) Applicant: Christian Egger, Valdosta, GA (US)

(72) Inventor: Christian Egger, Valdosta, GA (US)

( * ) Notice: Subject to any disclaimer, the term of this patent is extended or adjusted under 35 U.S.C. 154(b) by 0 days. days.

(21) Appl. No.: 15/641,820

(22) Filed: Jul. 5, 2017

(51) Int. Cl.
*A44C 3/00* (2006.01)

(52) U.S. Cl.
CPC ..... *A44C 3/002* (2013.01)

(58) Field of Classification Search
CPC ..... A44C 3/002
See application file for complete search history.

(56) References Cited

U.S. PATENT DOCUMENTS 2,495,577 A * 1/1950 Elkies ..... A44C 3/002 40/1.6
2,795,876 A * 6/1957 Hayes ..... A44C 3/002 40/1.5
3,192,655 A * 7/1965 Harn ..... A44C 3/002 40/1.5
3,455,042 A * 7/1969 Carr ..... A44C 3/002 40/1.5
3,579,881 A * 5/1971 Cherry ..... A44C 3/002 40/1.5
3,942,273 A * 3/1976 Adams ..... A44C 3/002 40/1.5
6,122,805 A * 9/2000 Haegley ..... A44B 17/0082 24/114.05
7,096,614 B1 8/2006 Williams
7,181,879 B1 2/2007 Key

OTHER PUBLICATIONS

Groupe Martineau, "Ribbons and Medals Mounting Kits by Martineau—France", YouTube, Jan. 18, 2016 retrieved from https://www.youtube.com/watch?v=-v16Uvq2TH4 on Sep. 22, 2017.
Vanguard, "Mega Ribbon Kit: 32 Ribbon—Clear, No Space", Mar. 10, 2015 to Aug. 2, 2016, Internet Archive, <https://web.archive.org/web/20150515000000*/https://www.vanguardmil.com/products/clear-32-ribbon-mega-ribbon-kit-with-no-space> on Sep. 22, 2017.
Vanguard, "Ribbon Mounting Bar: Base Single Bar—Brass", Mar. 20, 2015 to Jun. 28, 2016, Internet Archive, <https://web.archive.org/web/*/https://www.vanguardmil.com/products/brass-1-ribbon-or-2-mini-medals-base-single-bar-ribbon-mounting-bar on Sep. 22, 2017.

* cited by examiner

*Primary Examiner* — Gary C Hoge
(74) *Attorney, Agent, or Firm* — Alston & Bird LLP

(57) ABSTRACT

A modular military ribbon holder assembly kit includes a rack including a back portion, an upper portion, and a lower portion, a connector configured to engage the rack, where the connector includes an area defined in the lateral direction and a vertical direction that is less than an area of the rack defined in a lateral direction and the vertical direction, a plurality of engagement members extending outward from one of the back portion of the rack or the connector, a plurality of apertures defined by the other of the back portion of the rack or the connector, and a pin configured to selectively couple the connector to an article of fabric.

20 Claims, 8 Drawing Sheets

MODULAR MILITARY RIBBON HOLDER ASSEMBLY

BACKGROUND

Military ribbons, ribbon bars, and medals are worn on uniforms and may indicate the military service and personal accomplishments of the individual wearing the ribbons. For example, the ribbons may indicate personal decorations, participation in various campaigns, unit awards, service awards, or the like. Various embodiments of ribbon holder assemblies for fastening military ribbons to a uniform are described herein.

DESCRIPTION OF RELATED ART

Military ribbons may be fastened to the uniform by a ribbon holder or ribbon rack. Conventional ribbon holders are configured to hold a predefined number of ribbons, however, throughout an individual's career, additional ribbons may be awarded in recognition of the individual's service. Accordingly, the ribbon holder may need to be replaced with a new ribbon holder configured to accommodate the additional ribbons, which may be costly and cumbersome as the individual continues to receive awards and commendations throughout his or her career.

As one example, U.S. Pat. No. 3,942,273 describes a military ribbon holder including a plurality of horizontal and parallel ribbon support channels. Threaded pins are attached to the ribbon support channels, and the threaded pins may be used to attach the ribbon support channels to a uniform. The ribbon support channels are of a fixed length that is greater than a length of a single ribbon. As a result the ribbon support channels are configured to be used with a predetermined number of military ribbons, and lack the flexibility to add additional ribbons beyond the predetermined number of military ribbons. Further the ribbon support channels may be unsuitable for use with less than the predetermined number of military ribbons as at least a portion of the support channels would not be obscured by a military ribbon and would be visible when viewed from the front.

As another example, U.S. Pat. No. 7,096,614 describes a military ribbon assembly including a blank sheet including apertures configured to receive pegs extending from ribbon base panels. Each of the blanks are larger than a single military ribbon, and each of the blanks are configured to hold a predetermined number of military ribbons. As a result, the blanks lack the flexibility to add additional ribbons and must be replaced as an individual obtains additional ribbons.

As another example, U.S. Pat. No. 2,795,876 describes a mounting for service ribbons including a base plate including elongated bars that are longer than a length of a single military ribbon. The base plates include a plurality of slots between the elongated bars such that rows may be separated from the baseplate along the slots. As a result, by removing rows from the base plate, the base plates may be configured to hold a particular number of military ribbons. However, once configured and the rows have been removed from the base plate, the base plate lacks the flexibility to add additional ribbons, and must be replaced when an individual wishes to add new ribbons.

As another example, U.S. Pat. No. 7,181,879 describes a protective covering device for preventing damage to military ribbons. The protective covering is described as having fixed dimension that holds a predetermined number of ribbons. Accordingly, the protective covering lacks the flexibility to add additional ribbons beyond the predetermined number of ribbons. Furthermore, the protective covering does not describe the manner in which ribbons are attached to a uniform, but merely describes a covering that extends over military ribbons.

As another example, U.S. Pat. No. 6,122,805 describes a ribbon holder for securing ribbons to a uniform, where the ribbon holder is secured to a uniform by a securing device. The ribbon support channels a length that is greater than a length of a single ribbon. As a result the ribbon support channels are configured to be used with a predetermined number of military ribbons, and lack the flexibility to add additional ribbons beyond the predetermined number of military ribbons. Further the ribbon support channels may be unsuitable for use with less than the predetermined number of military ribbons as at least a portion of the support channels would not be obscured by a military ribbon and would be visible when viewed from the front.

As yet another example, U.S. Pat. No. 3,579,881 describes a military ribbon holder including elongated mounting bars that have a length that is greater than a single ribbon. As a result the mounting bars are configured to be used with a predetermined number of military ribbons, and lack the flexibility to add additional ribbons beyond the predetermined number of military ribbons. Further, the mounting bars may be unsuitable for use with less than the predetermined number of military ribbons as at least a portion of the mounting bars would not be obscured by a military ribbon and would be visible when viewed from the front.

As yet another example, U.S. Pat. No. 2,495,577 describes a ribbon carrying means including an elongated strips that hold one or more ribbons. The elongated strips include pins that are configured to be directly attached to a uniform. As a result, the elongated strips are not selectively coupled to one another and as an individual receives additional ribbons, the ribbons on the elongated strips may need to be rearranged.

As yet another example, U.S. Pat. No. 3,455,042 describes a ribbon holding device including a plurality of ribbon supporting members that are attached to a vertical backing strip. Multiple ribbon supporting members are attached to each of the vertical backing strips. As a result, each of the ribbon holding devices hold a predetermined number of ribbons, and lack the flexibility to add additional ribbons beyond the predetermined number of military ribbons. Further, the ribbon holding devices may be unsuitable for use with less than the predetermined number of military ribbons as at least a portion of the ribbon supporting members would not be obscured by a military ribbon and would be visible when viewed from the front.

Accordingly, a need exists for modular military ribbon holders configured to accommodate a variable number of military ribbons.

BRIEF SUMMARY

In one embodiment, a modular military ribbon holder assembly kit includes a rack including a back portion, an upper portion, and a lower portion, a connector configured to engage the rack, where the connector includes an area defined in the lateral direction and a vertical direction that is less than an area of the rack defined in a lateral direction and the vertical direction, a plurality of engagement members extending outward from one of the back portion of the rack or the connector, a plurality of apertures defined by the other of the back portion of the rack or the connector, and a pin configured to selectively couple the connector to an article of fabric.

In another embodiment, a modular military ribbon holder assembly includes a first rack configured to be selectively coupled to a military ribbon, the first rack including a first back portion, and a first plurality of engagement members, a second rack configured to be selectively coupled to a military ribbon, the second rack including a second back portion, and a second plurality of engagement members, a connector including a pair of apertures spaced apart from one another in a lateral direction, where one of the pair of apertures is configured to engage one of the first plurality of engagement members and the other of the pair of apertures is configured to engage the second plurality of engagement members, and where the connector has an area that is less than an area defined by the first rack and less than an area defined by the second rack, and a pin configured to selectively couple the connector to an article of fabric.

In yet another embodiment, a modular military ribbon holder assembly kit includes a rack including a back portion, an upper portion, and a lower portion, where the rack is configured to be selectively coupled to a military ribbon and where the rack has a length evaluated in a lateral direction that is less than a length of the military ribbon in the lateral direction, a connector configured to engage the rack, where the connector includes an area defined in the lateral direction and a vertical direction that is less than an area of the rack defined in the lateral direction and the vertical direction, and a pin configured to selectively couple the connector to an article of fabric.

BRIEF DESCRIPTION OF THE SEVERAL VIEWS OF THE DRAWINGS

Reference will now be made to the accompanying drawings, which are not necessarily drawn to scale, and wherein.

DETAILED DESCRIPTION

Figure 1:
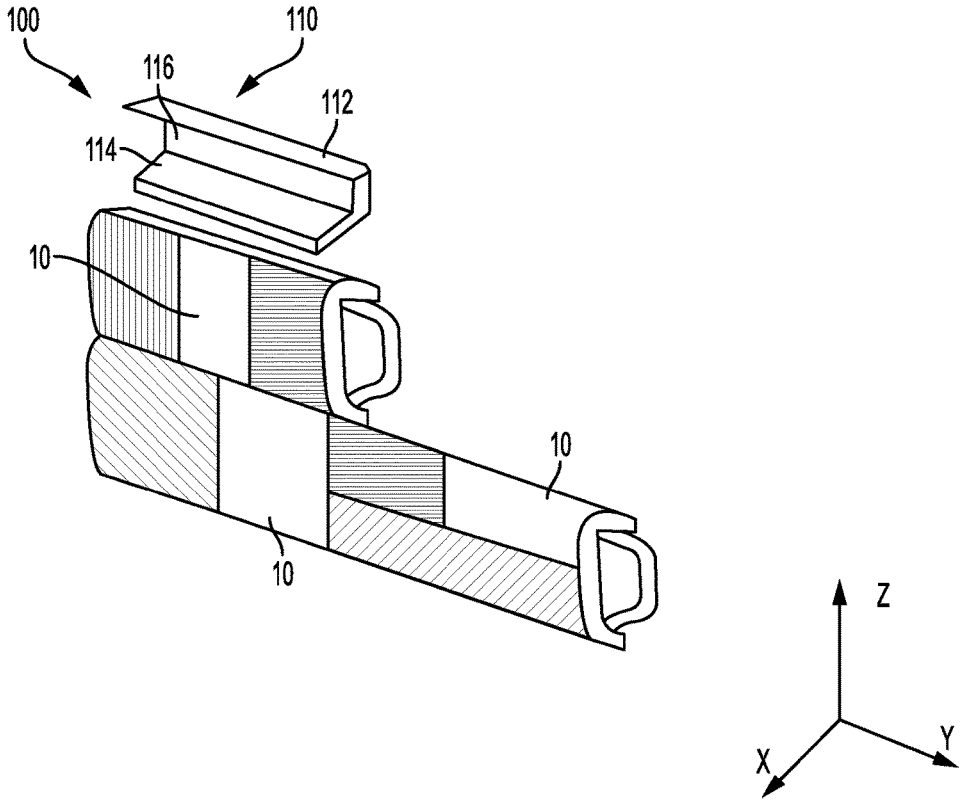
FIG. 1 schematically depicts a front view of ribbons selectively coupled to the modular ribbon holder assembly according to one or more embodiments shown and described herein.

Various embodiments now will be described more fully hereinafter with reference to the accompanying drawings, in which some, but not all embodiments are shown. Indeed, these inventions described herein may be embodied in many different forms and should not be construed as limited to the embodiments set forth herein; rather, these embodiments are provided so that this disclosure will satisfy applicable legal requirements. The term "or" is used herein in both the alternative and conjunctive sense, unless otherwise indicated. The terms "illustrative" and "exemplary" are used to be examples with no indication of quality level. And terms are used both in the singular and plural forms interchangeably. Like numbers refer to like elements throughout.

Many modifications and other embodiments of the inventions set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

As used herein, the vertical direction (e.g., the +/−Z-direction as depicted) refers to the upward/downward direction of various components described herein. The longitudinal direction (e.g., the +/−X-direction as depicted) refers to the forward/rearward direction of the components described herein and is transverse to the vertical direction. The lateral direction (e.g., the +/−Y-direction as depicted) refers to the cross-wise direction of the components described herein and is transverse to the vertical direction and the longitudinal direction.

Modular Military Ribbon Holder

Modular military ribbon holder assemblies are described herein. The ribbon holder assemblies generally include racks to which ribbons may be selectively coupled. The racks are each configured to hold a single ribbon or medal, and multiple racks are selectively coupled to one another by connectors to form the ribbon holder assembly. In embodiments, one of the rack or connectors include one or more engagement members and the other of the rack or connector includes one or more apertures that have a complementary shape configured to engage the engagement member. Multiple racks can be selectively coupled to, and decoupled from, one another with the connectors, thereby allowing easy re-configuration of the racks, and accordingly re-configuration of the ribbons and/or medals coupled to the racks. Furthermore, as each rack holds a single ribbon and/or medal, once installed to the rack, the position of the ribbon and/or medal may be re-configured within the ribbon holder assembly without removing the ribbon and/or medal from the rack, which may reduce damage to the ribbon resulting from the installation and removal of the ribbon from the rack.

Referring initially to FIG. 1, a front view of military ribbons 10 selectively coupled to a modular military ribbon holder assembly 100 is schematically depicted. Military and other public service organizations may present ribbons and/or medals to an individual in recognition of different honors, and the ribbons and/or medals may indicate personal decorations, participation in various campaigns, unit awards, service awards, or the like. Each ribbon 10 may have the same or similar dimensions, and service members may wear his or her collection of ribbons 10 on a dress uniform. Medals, which may include a ribbon portion similar to the ribbon 10 depicted in FIG. 1, may include a medal hanging below the ribbon portion, and may similarly be coupled to the ribbon holder assembly 100. The terms "medal" and "ribbon" are used interchangeably herein to refer to both military medals and ribbons.

As shown in FIG. 1, the ribbons 10 are selectively coupled to the ribbon holder assembly 100, which may be used to attach the ribbons 10 to the fabric of a uniform. The ribbon holder assembly 100 generally includes at least one rack 110 having an upper portion 112 and a lower portion 114 that extend outward from a back portion 116. In the embodiment depicted in FIG. 1, the upper portion 112 and the lower portion 114 form flanges that extend outward from the back portion. The upper portion 112 may extend outward from the back portion 116 and upward in the vertical direction. The lower portion 114 may extend outward from the back portion 116 and downward in the vertical direction. The upper portion 112 and the lower portion 114 of the rack 110 may have a complementary shape to the ribbon 10, such that the ribbon 10 may be selectively coupled to the rack 110 at the upper portion 112 and the lower portion 114. In particular, the ribbon 10 may slide on to the upper portion 112 and the lower portion 114 in the lateral direction and may be retained in place by the upper portion 112 and the lower portion 114.

Figure 2:
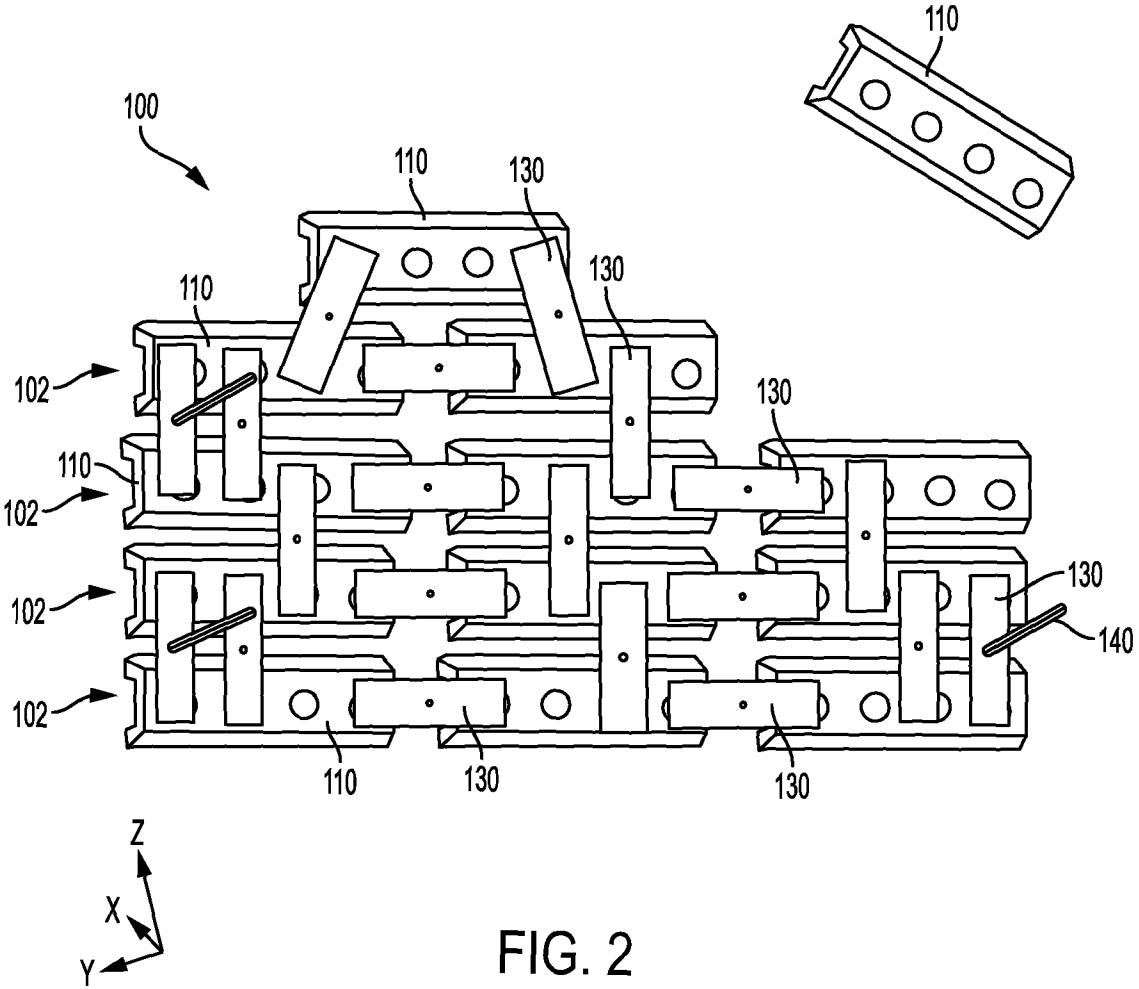
FIG. 2 schematically depicts a rear view of a modular ribbon holder assembly according to one or more embodiments shown and described herein.

Referring to FIG. 2, a rear view of multiple racks 110 of a ribbon holder assembly 100 is depicted. The racks 110 are coupled to one another by connectors 130 that extend between the racks 110 to form the ribbon holder assembly 100. The ribbon holder assembly 100 includes rows 102 having multiple racks 110 that extend in the lateral direction, and the rows 102 are assembled adjacent to one another in the vertical direction. In the embodiment depicted in FIG. 2, the rows 102 are assembled to include three racks 110 positioned adjacent to one another in the lateral direction, and adjacent racks 110 are coupled to one another by a connector 130 extending between the racks 110 in the lateral direction. Connectors 130 also extend between the rows 102 in the vertical direction to couple racks 110 of the different rows 102 to one another. In the embodiment shown in FIG. 2, each of the rows 102 include three racks 110 coupled to one another, however, it should be understood that any suitable number of racks 110 may be coupled to one another in a row 102 to accommodate multiple ribbons 10 (FIG. 1) in accordance with various dress rules and regulations. Furthermore, the ribbon holder assembly 100 may include any suitable number of rows 102 to display ribbons 10 (FIG. 1) in accordance with the various dress rules and regulations.

Figure 3:
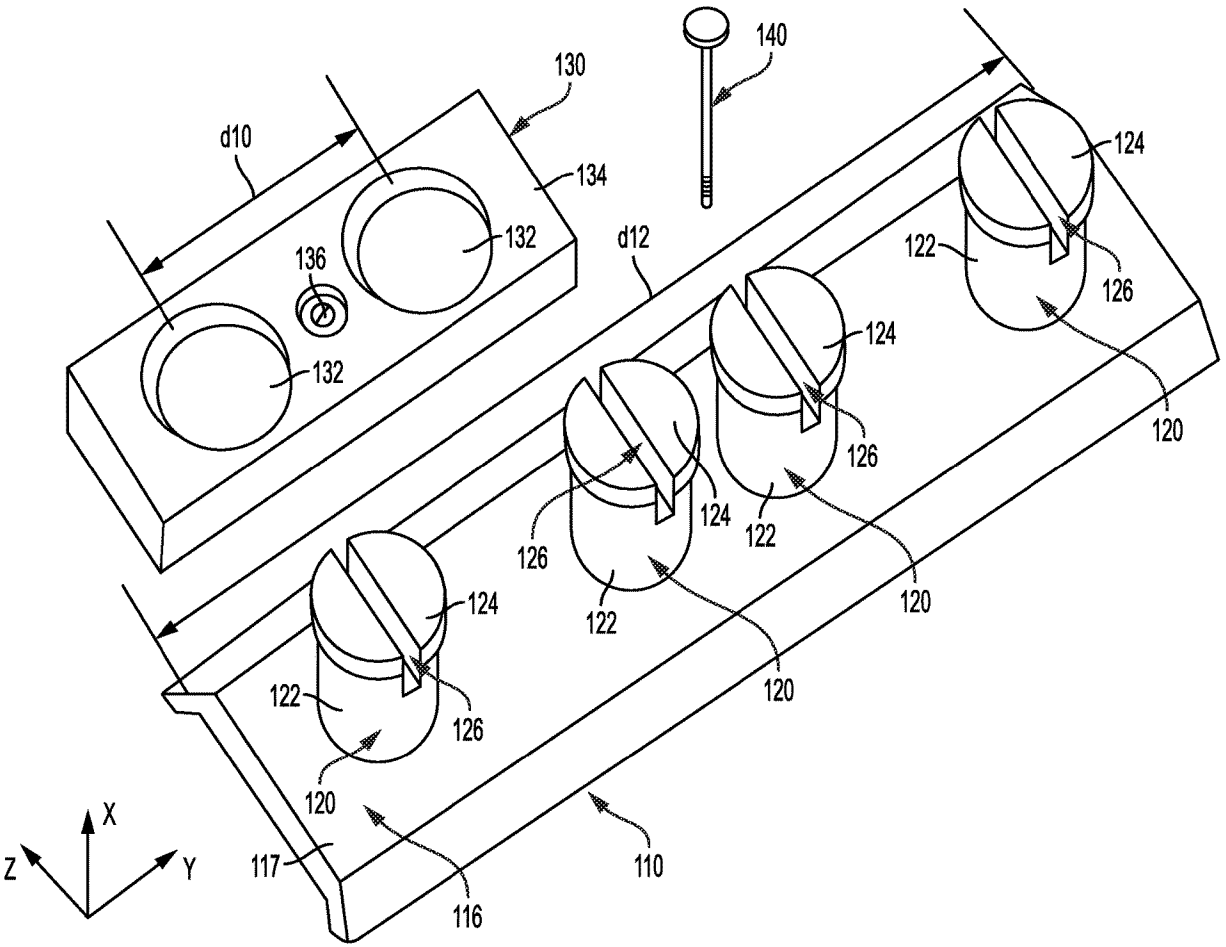
FIG. 3 schematically depicts a perspective view of a rack, a connector, and a pin of the modular ribbon holder assembly of FIG. 2 according to one or more embodiments shown and described herein.

Referring to FIG. 3, an enlarged perspective view of a rack 110, a connector 130, and a pin 140 are schematically depicted. In embodiments, the rack 110 is generally configured to hold a single ribbon 10 (FIG. 1) without modification to the rack 110 (i.e., without cutting or trimming to size), which allows for the modular addition of ribbons 10 to the ribbon holder assembly 100. In embodiments, the rack 110 has a length d12 evaluated in the lateral direction that correlates to the length of a ribbon 10 (FIG. 1) evaluated in the lateral direction. In embodiments, the rack 110 has a length that is within about 2 mm less than the length of the ribbon. For example, in branches of the United States Military, ribbons 10 (FIG. 1) may generally have a length of between about 35.5 millimeters (mm) to about 36.5 mm inclusive of the endpoints, and the length d12 of the rack 110 may be about 35 mm to correlate with the length of the ribbon 10. In some configurations, such as when the ribbons 10 (FIG. 1) include a medal, the ribbons 10 may generally have a length of between about 18.5 mm to about 19 mm inclusive of the endpoints, and the length d12 of the rack 110 may be about 18 mm to correlate with the length of the ribbon 10. In this way, each rack 110 may hold a single ribbon 10, and as the ribbon 10 has a length that is greater than the length d12 of the rack 110, the rack 110 may be substantially obscured by the ribbon 10 when viewed from the front. Further, because each rack 110 is configured to hold a single ribbon 10, new individual racks 110 (and associated individual ribbons 10) may be added to the ribbon holder assembly 100 without requiring the removal or rearrangement of existing ribbons 10 from existing racks of the ribbon holder assembly 100. By contrast, in ribbon assemblies that have racks that hold multiple ribbons, when a new ribbon is added to the assembly, existing ribbons may be removed and re-arranged on the rack, and/or may need to be placed on a newly purchased rack. This may result in increased costs, and the removal from and re-installation to the racks may cause damage to the ribbons. Accordingly, by including modular racks 110 that each hold a single ribbon, costs and damage to the ribbons may be reduced.

The rack 110 generally includes one or more retention members 120 that are configured to engage with the connector 130 and selectively couple the rack 110 to the connector 130. In the embodiment depicted in FIG. 3, the retention members 120 include posts 122 that extend outward from a rear face 117 of the rack 110 and the connector 130 defines apertures 132 that extend at least partially into a face 134 of the connector 130. In the embodiment depicted in FIG. 3, the connector 130 includes at least two apertures 132, where one of the apertures 132 may be selectively coupled to a post 122 of one rack 110, while the other aperture 132 may be selectively coupled to a post 122 of another rack 110 to couple the racks 110 together. The apertures 132 are spaced apart from one another by a distance d10 evaluated between the center points of the apertures 132 in the lateral direction. The distance d10 may be selected such that the apertures 132 extend between engagement members 120 of different racks 110, as will be described in greater detail herein.

Each connector 130 is configured to couple one rack 110 to another rack 110, and each connector 130 generally has an area defined in the vertical and the lateral directions that is less than an area of each rack 110 defined in the vertical and vertical and lateral direction. In this way, when coupled to a pair of racks 110, each connector 130 may be substantially obscured by the racks 110 and associated ribbons 10 (FIG. 1) when viewed from the front of the ribbon holder assembly 100.

The posts 122 are configured to be at least be partially inserted within the apertures 132 to couple the rack 110 to the connector 130. In the embodiment depicted in FIG. 3, each of the posts 122 include a generally cylindrical shape extending outward from the back portion 116 of the rack 110, and the apertures 132 generally include a circular shape that is complementary with the posts 122. In other embodiments, the posts 122 and the apertures 132 may include any suitable and complementary shapes, for example, the posts 122 may include a rectangular prism shape and the apertures 132 may include a square shape, or the posts 122 may include a triangular prism shape and the apertures 132 may include a triangle shape.

Each post 122 may include a flange 124 that extends outward from the post 122, and each post 122 may include a slit 126 extending at least partially into the post 122. The posts are configured to elastically deform inward about the slits 126, for example, when the post 122 is inserted within the aperture 132 of the connector 130. In some embodiments, the flange 124 may have an outer diameter that is greater than an inner diameter of a corresponding aperture 132, such that when the flange 124 is inserted within the aperture 132, the flange 124 elastically deforms inward about the slit 126. In embodiments in which the apertures 132 extend entirely through the connector 130, the posts 122 of the rack 110 may be configured to be inserted through the apertures 132, and interference between the flange 124 and the face 134 of the connector 130 may selectively couple the rack 110 to the connector 130. In other embodiments, once inserted at least partially into the apertures 132, the connector 130 may be coupled to the rack 110 by a snug fit between the flange 124 and/or the post 122 and the aperture 132.

A pin 140 may be selectively engaged with, and may be removable from, the connector 130 such that the connector 130 (and rack or racks 110 coupled to the connector 130) may be pinned to an article of clothing, such as a dress uniform. In the embodiment depicted in FIG. 3, the connector 130 includes a pin hole 136 that is configured to accept the pin 140. In embodiments, some connectors 130 may be installed to the ribbon holder assembly 100 without a pin 140, such that the connector 130 couples racks 110 to one another. Other connectors 130 may be installed to the ribbon holder assembly 100 with a pin 140 such that the connector 130 may couple racks 110 to one another and/or pin the ribbon holder assembly 100 to an article of clothing. The pin 140 may be coupled to a clasp, such as a butterfly clutch clasp or the like to pin the connector 130 to the article of clothing.

In embodiments, the racks 110, the posts 122, the connectors 130, and the pin 140 may be formed from any suitable material. For example and without limitation, the racks 110, the posts 122, and the connectors may be formed from brass, copper, steel, a composite, a plastic or the like, and may be formed through any suitable manufacturing process, such as stamping, forging, machining, molding, or the like.

Figure 4A:
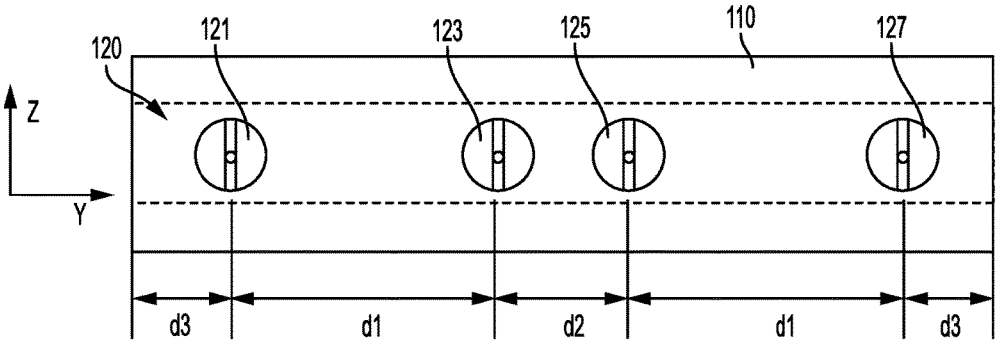
FIG. 4A schematically depicts a top view of the rack of FIG. 3 according to one or more embodiments shown and described herein.
Figure 4B:
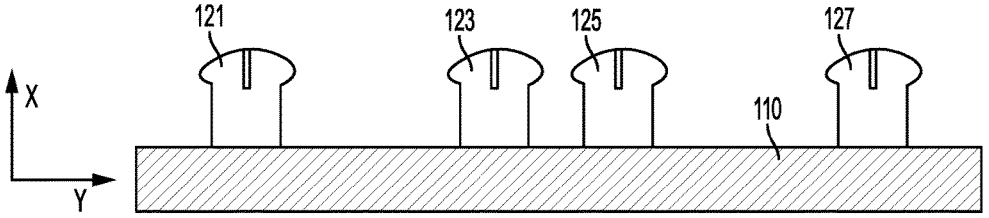
FIG. 4B schematically depicts a side view of the rack of FIG. 3 according to one or more embodiments shown and described herein.
Figure 4C:
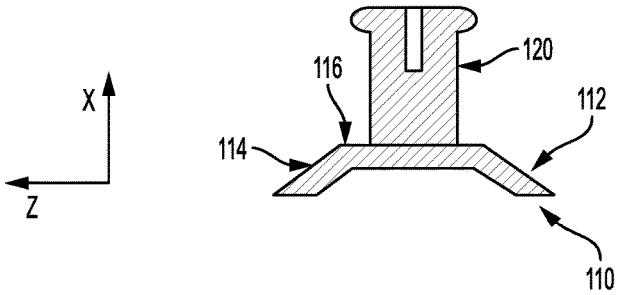
FIG. 4C schematically depicts an end view of the rack of FIG. 3 according to one or more embodiments shown and described herein.

Referring to FIGS. 4A, 4B, and 4C, a top view, a side view, and an end view of a rack 110 are schematically depicted, respectively. As shown, the retention members 120 on the rack 110 include a first retention member 121, a second retention member 123, a third retention member 125, and a fourth retention member positioned on the rack 110. The second retention member 123 and the third retention member 125 are positioned between the first and the fourth retention members 121, 127 in the lateral direction. In the embodiment depicted in FIGS. 4A-4C, the retention members 120 are irregularly spaced along the rack 110 in the lateral direction. In particular, the first retention member 121 and the second retention member 123 are spaced apart from one another by a distance d1 evaluated between centerlines of the first retention member 121 and the second retention member 123. The second retention member 123 is spaced apart from the third retention member 125 by a distance d2 evaluated between centerlines of the second retention member 123 and the third retention member 125, where d1 is greater than d2. The third retention member 125 is spaced apart from the fourth retention member 127 by the first distance d1 (i.e., the same distance evaluated between the centerlines of the first and the second retention members 121, 123). Put another way, the centrally positioned retention members (i.e., the second retention member 123 and the third retention member 125) are positioned closer to one another as compared to the centrally positioned retention members with respect to the outer retention members (i.e., the first retention member 121 and the second retention member 127).

In embodiments, the distance d1 between the first retention member 121 and the second retention member 123 and between the third retention member 125 and the fourth retention member 127 may be selected to be the same as distance d10 (FIG. 3) between the apertures 132 of the connector 130. In some configurations, such as when a single rack 110 is to be attached to a uniform, one or more connectors 130 (FIG. 3) may be attached to the retention members 120 of the rack 110. In particular, as the distance d1 between the first and second retention members 121, 123 and between the third and fourth retention members 125, 127 is the same as the distance d10 between the apertures 132 of the connector 130, a connector 130 (and pin 140) may be coupled to the rack 110 spanning between the first and second retention members 121, 123 and spanning between the third and fourth retention members 125, 127.

In the embodiment depicted in FIGS. 4A-4C, the first retention member 121 is spaced apart from a proximate side edge of the rack 110 by a distance d3 evaluated between the centerline of the first retention member 121 and the edge in the lateral direction. The fourth retention member 127 is similarly spaced apart from a proximate side edge of the rack 110 by the distance d3 evaluated between the centerline of the fourth retention member 127 and the edge in the lateral direction. The first retention member 121 and the fourth retention member 127 are positioned on the rack 110 such that the first retention member 121 of one rack 110 may be selectively coupled to the fourth retention member 127 of an adjacent rack 110, as will be described in greater detail herein.

Figure 5:
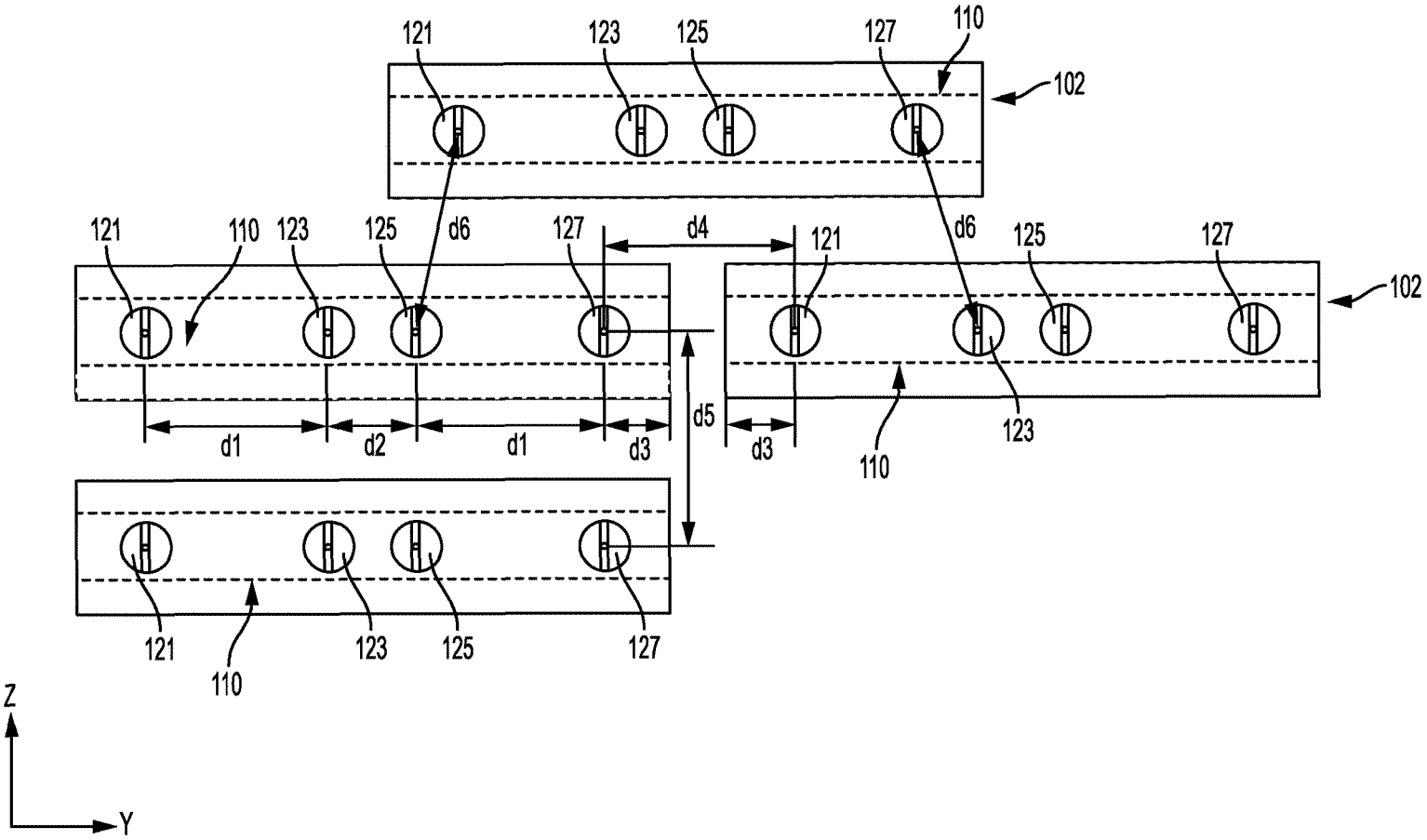
FIG. 5 schematically depicts a top view of racks of the modular ribbon holder assembly of FIG. 2 according to one or more embodiments shown and described herein.

Referring to FIG. 5, a rear view of racks 110 arranged to be assembled is schematically depicted. The racks 110 may be arranged in a manner such that connectors 130 (FIG. 3) may be positioned between the racks 110 to couple the racks 110 to one another. As described above, the first retention member 121, the second retention member 123, the third retention member 125, and the fourth retention member 127 are irregularly spaced on the rack 110. When assembled, racks 110 that are adjacent to one another in the lateral direction may be positioned such that the first retention member 121 of one rack 110 and the fourth retention member 127 of an adjacent rack 110 are spaced apart by a distance d4 evaluated between the centerlines of the first retention member 121 and the fourth retention member 127 in the lateral direction. The distance d4 may be the same as the distance d10 (FIG. 3) between the apertures 132 of the connector 130 such that a connector 130 may be selectively coupled to the respective first retention member 121 and the fourth retention member 127 to couple the racks 110 to one another.

Racks 110 that are positioned directly above and below one another in the vertical direction may be positioned such that the retention members of each rack 110 are spaced apart from each other by a distance d5 evaluated between the centerlines of the retention members of each of the racks in the vertical direction. The distance d5 may be the same as the distance d10 (FIG. 3) between the apertures 132 of the connector 130 such that a connector 130 may be selectively coupled to any of the opposing retention members of the racks 110 to couple the racks 110 to one another.

In arrangements in which one rack 110 is positioned above another rack 110 in the vertical direction and offset in the lateral direction, the racks 110 may be positioned such that the first retention member 121 of the upper rack 110 is spaced apart from the third retention member 125 of the lower rack 110 by a distance d6. The fourth retention member 127 of the upper rack 110 may be similarly spaced apart from the second retention member 123 of another adjacent rack 110 by the distance d6. The distance d6 may be the same as the distance d10 (FIG. 3) between the apertures 132 of the connector 130 such that a connector 130 may be selectively coupled to the first retention member 121 of the upper rack 110 and the third retention member 125 of the lower rack 110 to couple the racks 110 to one another. In this way, a rack 110 may be coupled racks 110 that are adjacent to it in the vertical direction, the lateral direction, and that are offset from the rack 110 in the vertical direction with the connectors 130.

Figure 6:
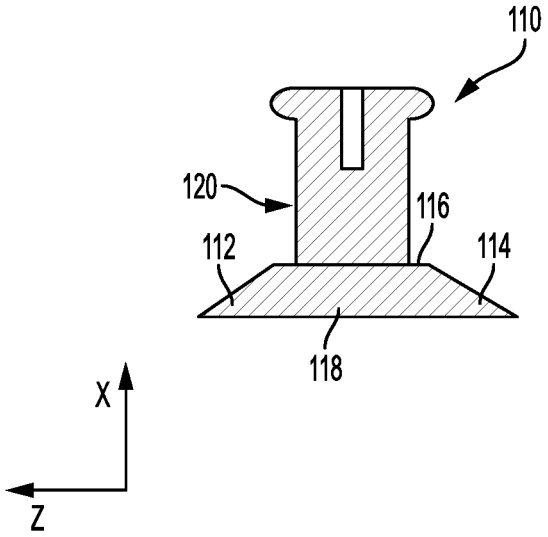
FIG. 6 schematically depicts an end view of another rack according to one or more embodiments shown and described herein.

Referring to FIG. 6, another embodiment of a rack 110 is depicted. In some embodiments, the upper portion 112, the lower portion 114, and the back portion 116 form a solid body 118 of the rack 110, as compared to the flanges depicted in FIGS. 4A-4C.

Figure 7:
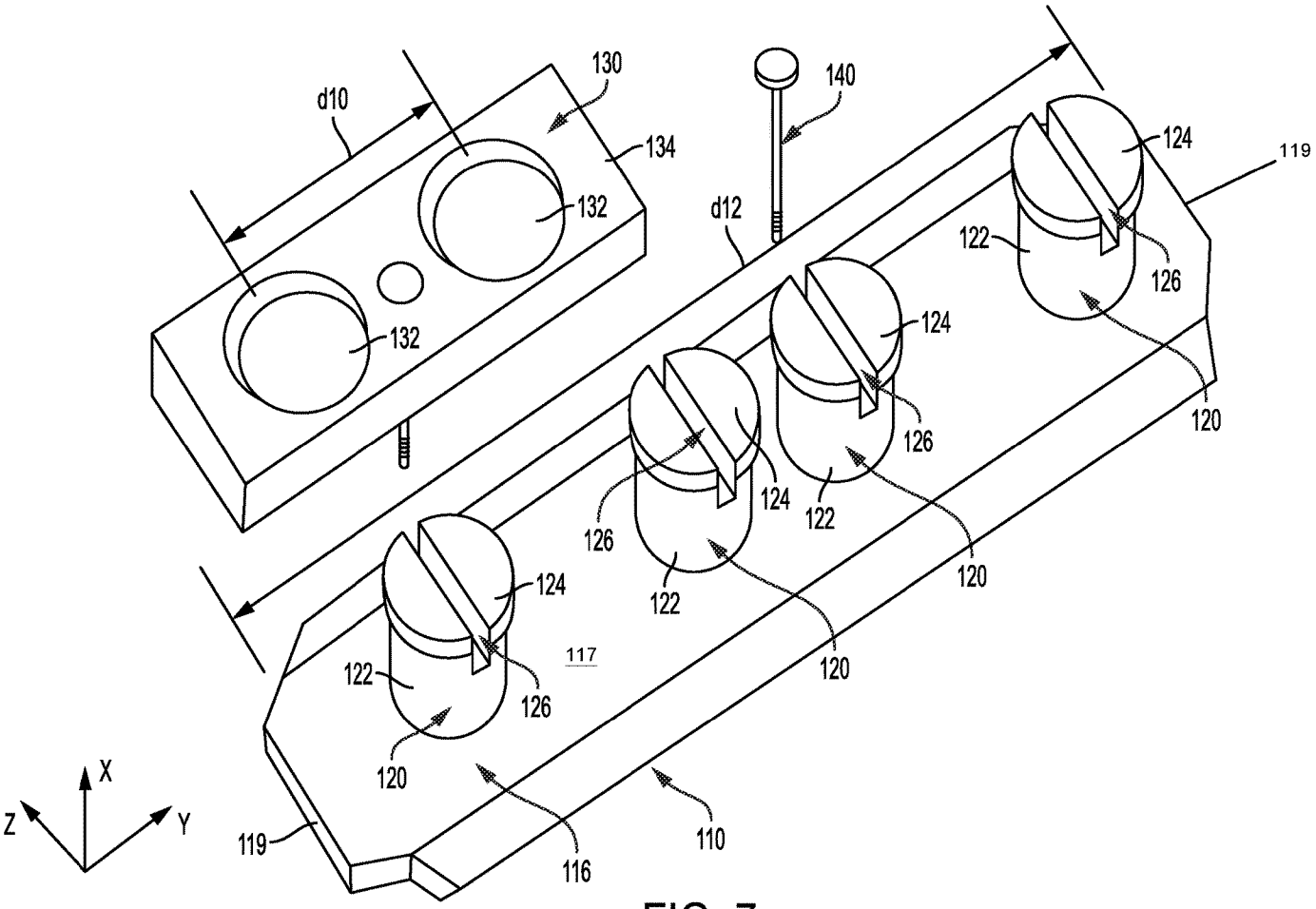
FIG. 7 schematically depicts perspective view of another rack, connector, and pin according to one or more embodiments shown and described herein.
Figure 8:
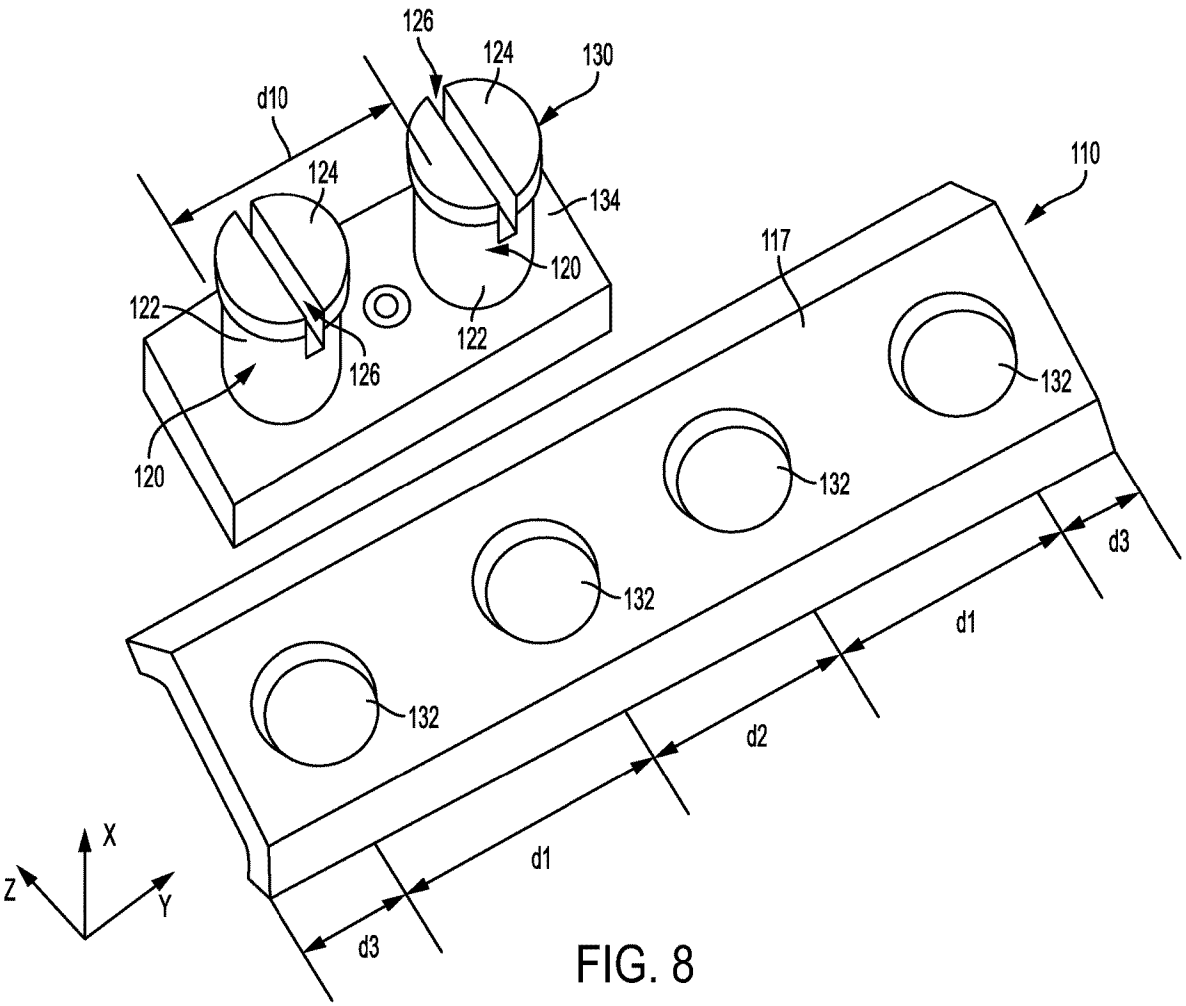
FIG. 8 schematically depicts a perspective view of another rack and connector according to one or more embodiments shown and described herein.

Referring to FIG. 7, another embodiment of a rack 110 is depicted. In some embodiments, the rack 110 includes tapered edges 119 on the lateral sides of the rack 110, where the tapered edges 119 increase in height evaluated in the vertical direction moving inward along the rack 110. The tapered edges 119 may assist in guiding ribbons 10 (FIG. 1) onto the rack 110.

Referring to FIG. 7, another embodiment of the rack 110 and the connector 130 are schematically depicted. In the embodiment depicted in FIG. 7, the connector 130 includes a pair of retention members 120 extending outward from the connector 130, while the rack 110 includes at least one aperture 132 extending at least partially through the rack 110. The apertures 132 on the rack may be similarly spaced apart from one another as the first retention member 121, the second retention member 123, the third retention member 125, and the fourth retention member 127 of the rack 110 depicted in FIG. 4A. Similarly, the retention members 120 of the connector 130 may be positioned on connector in a similar manner as the apertures 132 of the connector depicted in FIG. 4A.

Accordingly, it should now be understood that modular ribbon holder assemblies described herein include racks to which ribbons may be selectively coupled. The ribbon holder assemblies generally include racks to which ribbons may be selectively coupled. The racks are each configured to hold a single ribbon or medal, and multiple racks are selectively coupled to one another by connectors to form the ribbon holder assembly. In embodiments, one of the rack or connectors include one or more engagement members and the other of the rack or connector includes one or more apertures that have a complementary shape configured to engage the engagement member. Multiple racks can be selectively coupled to, and decoupled from, one another with the connectors, thereby allowing easy re-configuration of the racks, and accordingly re-configuration of the ribbons and/or medals coupled to the racks. Furthermore, as each rack holds a single ribbon and/or medal, once installed to the rack, the position of the ribbon and/or medal may be re-configured within the ribbon holder assembly without removing the ribbon and/or medal from the rack, which may reduce damage to the ribbon resulting from the installation and removal of the ribbon from the rack.

CONCLUSION

Many modifications and other embodiments of the inventions set forth herein will come to mind to one skilled in the art to which these inventions pertain having the benefit of the teachings presented in the foregoing descriptions and the associated drawings. For example, various embodiments may be configured to associate a plurality of assets with a particular sort location. In such embodiments, a sort employee may scan a plurality of asset identifiers (e.g., sequentially) before transporting the plurality of items to a sort location. Thereafter, the plurality of assets may be associated with the proximate sort location according to the features and methods described herein. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A modular military ribbon holder assembly kit comprising:

a rack comprising a back portion, an upper portion, and a lower portion;

a connector configured to engage the rack, wherein the connector comprises an area defined in the lateral direction and a vertical direction that is less than an area of the rack defined in a lateral direction and the vertical direction;

a plurality of engagement members extending outward from one of the back portion of the rack or the connector;

a plurality of apertures defined by the other of the back portion of the rack or the connector; and a pin configured to selectively couple the connector to an article of fabric.

2. The ribbon holder assembly kit of claim 1, wherein the plurality of engagement members comprises posts extending outward from the back portion of the rack or the connector.

3. The ribbon holder assembly kit of claim 2, wherein the plurality of engagement members further comprises flanges positioned at an end of the posts and that extend outward from the posts.

4. The ribbon holder assembly kit of claim 2, wherein the plurality of engagement members further comprises slits extending at least partially into the posts, and wherein the plurality of engagement members are each elastically deformable about the slits.

5. The ribbon holder assembly kit of claim 1, wherein the plurality of engagement members comprise a first engagement member, a second engagement member, a third engagement member, and a fourth engagement member, which are each spaced apart from one another in the lateral direction.

6. The ribbon holder assembly kit of claim 5, wherein the first engagement member is spaced apart from the second engagement member by a first distance, and the second engagement member is spaced apart from the third engagement member by a second distance, where the first distance is greater than the second distance.

7. The ribbon holder assembly kit of claim 1, wherein the plurality of engagement members extend outward from the back portion of the rack.

8. The ribbon holder assembly kit of claim 1, wherein the plurality of engagement members extend outward from the connector.

9. The ribbon holder assembly of claim 1, wherein the rack further comprises a tapered edge on a lateral side of the rack, wherein the height of the rack increases in height moving inward along the tapered edge.

10. A modular military ribbon holder assembly comprising:

a first rack configured to be selectively coupled to a military ribbon, the first rack comprising:
a first back portion; and
a first plurality of engagement members;

a second rack configured to be selectively coupled to a military ribbon, the second rack comprising:
a second back portion; and
a second plurality of engagement members;

a connector comprising a pair of apertures spaced apart from one another in a lateral direction, wherein one of the pair of apertures is configured to engage one of the first plurality of engagement members and the other of the pair of apertures is configured to engage the second plurality of engagement members, and wherein the connector has an area that is less than an area defined by the first rack and less than an area defined by the second rack; and a pin configured to selectively couple the connector to an article of fabric.

11. The ribbon holder assembly of claim 10, wherein the first plurality of engagement members comprises posts extending outward from the back portion of the first rack.

12. The ribbon holder assembly of claim 11, wherein the first plurality of engagement members further comprises flanges positioned at an end of the posts and that extend outward from the posts.

13. The ribbon holder assembly of claim 11, wherein the first plurality of engagement members further comprises slits extending at least partially into the posts, and wherein the first plurality of engagement members are each elastically deformable about the slits.

14. The ribbon holder assembly of claim 10, wherein the first plurality of engagement members comprise a first engagement member, a second engagement member, a third engagement member, and a fourth engagement member, which are each spaced apart from one another in the lateral direction.

15. The ribbon holder assembly of claim 14, wherein the first engagement member is spaced apart from the second engagement member by a first distance, and the second engagement member is spaced apart from the third engagement member by a second distance, where the first distance is greater than the second distance.

16. The ribbon holder assembly of claim 10, where in the first rack further comprises a tapered edge on a lateral side of the first rack, wherein the height of the first rack increases in height moving inward along the tapered edge.

17. A modular military ribbon holder assembly kit comprising:

a rack comprising a back portion, an upper portion, and a lower portion, wherein the rack is configured to be selectively coupled to a military ribbon and wherein the rack has a length evaluated in a lateral direction that is less than a length of the military ribbon in the lateral direction;

a connector comprising an area defined in the lateral direction and a vertical direction that is less than an area of the rack defined in the lateral direction and the vertical direction; and a pin configured to selectively couple the connector to an article of fabric, wherein:

one of the rack or the connector has at least one engagement member;

the other of the rack or the connector has at least one aperture configured to interact with at least one engagement member.

18. The ribbon holder assembly kit of claim 17, wherein the at least one engagement member comprises a plurality of engagement members, and the plurality of engagement members each extend outward either from the back portion of the rack or from the connector.

19. The ribbon holder assembly kit of claim 17, wherein the at least one engagement member comprises a plurality of engagement members that each extend outward from the back portion of the rack.

20. The ribbon holder assembly kit of claim 17, wherein the at least one aperture comprises a plurality of apertures defined on the connector.

* * * * *